US011497314B1

(12) United States Patent
Zhang

(10) Patent No.: US 11,497,314 B1
(45) Date of Patent: Nov. 15, 2022

(54) ADJUSTABLE HEADREST MECHANISM AND CHAIR HAVING SAME

(71) Applicant: SHANGHAI STERLING MOTION TECHNOLOGY CO., LTD., Shanghai (CN)

(72) Inventor: Yanjun Zhang, Shanghai (CN)

(73) Assignee: SHANGHAI STERLING MOTION TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 17/412,899

(22) Filed: Aug. 26, 2021

Related U.S. Application Data

(60) Provisional application No. 63/192,230, filed on May 24, 2021.

(51) Int. Cl.
*A47C 7/38* (2006.01)
*A47C 1/036* (2006.01)

(52) U.S. Cl.
CPC ..... *A47C 7/38* (2013.01); *A47C 1/036* (2013.01)

(58) Field of Classification Search
CPC ..... A47C 7/38; A47C 1/036; A47C 7/402
USPC ..... 297/408, 410
See application file for complete search history.

(56) References Cited

U.S. PATENT DOCUMENTS

| | | | | |
|---|---|---|---|---|
| 7,097,246 | B2 * | 8/2006 | Sedlatschek | A47C 7/38 297/284.3 |
| 9,282,827 | B1 * | 3/2016 | Lu | A47C 20/041 |
| 10,960,802 | B2 * | 3/2021 | Kotz | B60N 2/853 |
| 2016/0046218 | A1 * | 2/2016 | Worlitz | B60N 2/809 601/84 |

* cited by examiner

*Primary Examiner* — Sarah B McPartlin
(74) *Attorney, Agent, or Firm* — Locke Lord LLP; Tim Tingkang Xia, Esq.

(57) ABSTRACT

The adjustable headrest mechanism for a chair comprises a pair of sliding rails; an upper driving rod and a lower driving rod, the upper driving rod being attached to the sliding rails and the lower driving rod being attached to a back frame of the chair; and a headrest actuator pivotally connected between the upper driving rod and the lower driving rod for operably driving the upper driving rod to move between a first position and a second position, thereby driving the sliding rails to pivotally move in an upward direction or a downward direction relative to the lower driving rod. When the upper driving rod is in the first position, the sliding rails is in a complete close state. When the upper driving rod is in the second position, the sliding rails is in a complete open state.

17 Claims, 4 Drawing Sheets

ADJUSTABLE HEADREST MECHANISM AND CHAIR HAVING SAME

CROSS-REFERENCE TO RELATED PATENT APPLICATION

This application claims priority to and the benefit of U.S. provisional patent application Ser. No. 63/192,230, filed May 24, 2021, which is incorporated herein in its entirety by reference.

FIELD OF THE INVENTION

The invention generally relates to a chair, and more particular to an adjustable headrest and a chair having the same.

BACKGROUND OF THE INVENTION

Chairs are necessary furniture for people in every aspect of their lives. Conventional chairs do not have headrests that can be adjusted in accordance with user's preference. Nowadays people sit in chairs for long time every day, necks and waists are prone to discomfort, and spinal diseases are becoming more and more common. Thus, it is beneficial and desirable that chairs have headrests that are adjustable.

SUMMARY OF THE INVENTION

The invention, in one aspect, relates to an adjustable headrest and a chair having the same.

According to one aspect of the invention, the adjustable headrest mechanism for a chair comprises a pair of sliding rails transversely spaced, longitudinally aligned and arranged parallel to each other, each of the pair of sliding rails having an upper end portion and a lower end portion, and a sliding rail body portion formed therebetween; an upper driving rod and a lower driving rod longitudinally spaced, transversely aligned and arranged parallel to each other, wherein two end portions of the upper driving rod are attached to two lower end portions of the pair of sliding rails, and two end portions of the lower driving rod are operably attached to a back frame of the chair; and a headrest actuator pivotally connected between the upper driving rod and the lower driving rod for operably driving the upper driving rod to move between a first position and a second position, thereby driving the pair of sliding rails to pivotally move in an upward direction or a downward direction relative to the lower driving rod, wherein when the upper driving rod is in the first position, the pair of sliding rails is in a complete close state, and when the upper driving rod is in the second position, the pair of sliding rails is in a complete open state.

In one embodiment, each of the pair of sliding rails has a guiding groove formed in the sliding rail body portion.

In one embodiment, the guiding groove is an arc-shaped groove.

In one embodiment, the adjustable headrest mechanism further comprises a pair of side plates, each side plate operably coupled between a respective sliding rail of the pair of sliding rails and the back frame of the chair.

In one embodiment, each side plate has a first side operably attached to the back frame of the chair, an opposite, second side, and at least one guiding post fixed on the second side, wherein the at least one guiding post is received in the guiding groove of the said respective sliding rail of the pair of sliding rails such that said respective sliding rail is movable along the at least one guiding post.

In one embodiment, the at least one guiding post is riveted on, welded to, screwed in, or protruded from the second side of each side plate.

In one embodiment, each guiding post is equipped with a bushing and a gasket, wherein the bushing is adapted for isolating the sliding rail and the guiding post, and wherein the gasket is placed between the sliding rail and the side plate.

In one embodiment, the bushing and the gasket are formed of plastic.

In one embodiment, the two lower end portions of the pair of sliding rails are fixedly connected with the two end portions of the upper driving rod by screws and nuts, or other connection means, through holes formed on the two end portions of the upper driving rod, wherein the holes are waist-shaped slot holes adapted for adjusting a width between the pair of sliding rails.

In one embodiment, the headrest actuator comprises a slider pivotally connected to the upper driving rod, a guiding bar received in the slider, and a motor member engaged with the guiding bar and the slider to drive the slider to move along the guiding bar, thereby driving the upper driving rod to move between the first position and the second position.

In one embodiment, the slider is pivotally connected to the upper driving rod through an upper bracket mounted on the upper driving rod and a shaft screw connected to the slider and the upper bracket, such that the upper driving rod is rotatable around the shaft screw.

In one embodiment, the headrest actuator is also pivotally connected to the lower driving rod at a lower end portion of the headrest actuator that is proximate to the motor member through a lower bracket mounted on the lower driving rod and a pin pivotally connected to the lower end portion of the headrest actuator and the lower bracket.

In one embodiment, the adjustable headrest mechanism further comprises a headrest broad attached to the upper end portions of the pair of sliding rails.

In one embodiment, in operation, the motor member drives the slider to reciprocate up and down along the guiding bar, the reciprocation of the slider in turn drives the upper driving rod and thus the sliding rail to reciprocate up and down along the guiding post, thereby realizing the up and down movement of the headrest broad to operably adjust the headrest broad at desired positions.

In one embodiment, when the slider moves to the proximal end portion of the guiding bar, the upper driving rod is in the first position, the headrest broad is in the complete close state, and wherein when the slider moves to the distal end portion of the guiding bar, the upper driving rod is in the second position, the headrest broad is in the complete close state.

According to another aspect of the invention, the chair comprises a back frame; and an adjustable headrest mechanism attached to the back frame for operably adjusting a headrest at desired positions. The adjustable headrest mechanism is disclosed as above.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
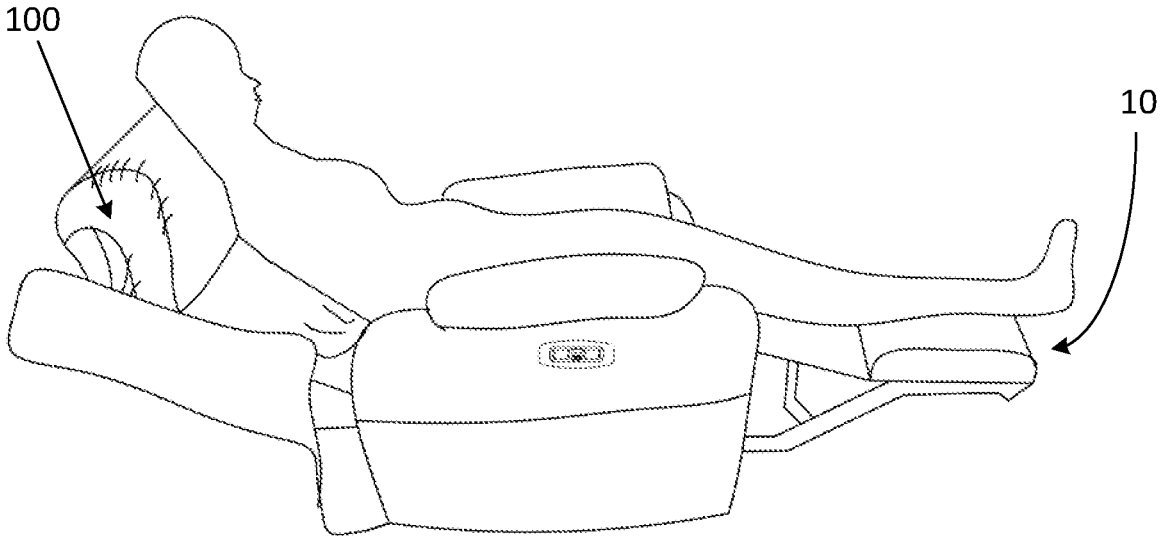
FIG. 1 shows schematically a perspective view of a chair with an adjustable headrest mechanism according to one embodiment of the invention.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

As used in this specification, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

In accordance with the purposes of this invention, as embodied and broadly described herein, this invention, in one aspect, relates to an adjustable headrest mechanism that utilizes an arc-shaped sliding rail structure to open (i.e., move in a upward direction) and close (i.e., move in a downward direction), can minimize the tilt angle of the headrest when opening, and ensure that the headrest is always in the surface contact with the user's head, thereby reducing the pressure of the headrest exerted on the head, and at the same time it can ensure that the user can look straight ahead more comfortably.

The adjustable headrest mechanism is driven by a linear push rod motor (e.g., linear slide actuator) with a wider slider. Accordingly, the stability of the connection of the adjustable headrest mechanism is improved significantly. Meanwhile, the structure can achieve a smaller installation distance, so that the entire structure is more compact.

In conjunction with the accompanying drawings of FIGS. 1-7, one or more embodiments of the invention are described below. The broad teachings of the invention can be implemented in a variety of forms.

Referring to FIGS. 1-7, and particularly to FIGS. 3-7, the adjustable headrest mechanism 100 are shown according to embodiments of the invention.

The adjustable headrest mechanism 100 includes a pair of sliding rails 110 (110A and 110B) transversely spaced, longitudinally aligned and arranged parallel to each other. As used herein, reference numeral 110, or 110A and 110B, refers to the pair of sliding rails, reference numeral 110/110A, or 110A, refers to a left sliding rail of the pair of sliding rails, and reference numeral 110/110B, or 110B, refers to a right sliding rail of the pair of sliding rails. Each 110A (110B) of the pair of sliding rails 110 has an upper end portion 111A (111B) and a lower end portion 112B (112B), a sliding rail body portion 113 formed therebetween, and a guiding groove 114 formed in the sliding rail body portion 113. In the exemplary embodiment shown in FIGS. 3-7, each of the upper end portion 111A (111B) and the lower end portion 112B (112B) is a tab transversely extending from the sliding rail body portion 113, and the guiding groove 114 is an arc-shaped groove. Each sliding rail 110A (110B) is also formed in an arc-shape. It should be noted that each sliding rail 110A (110B) can also be formed in other shapes.

The adjustable headrest mechanism 100 further comprises a headrest broad 170 attached to the upper end portions 111A and 111B of the pair of sliding rails 110.

Figure 6:
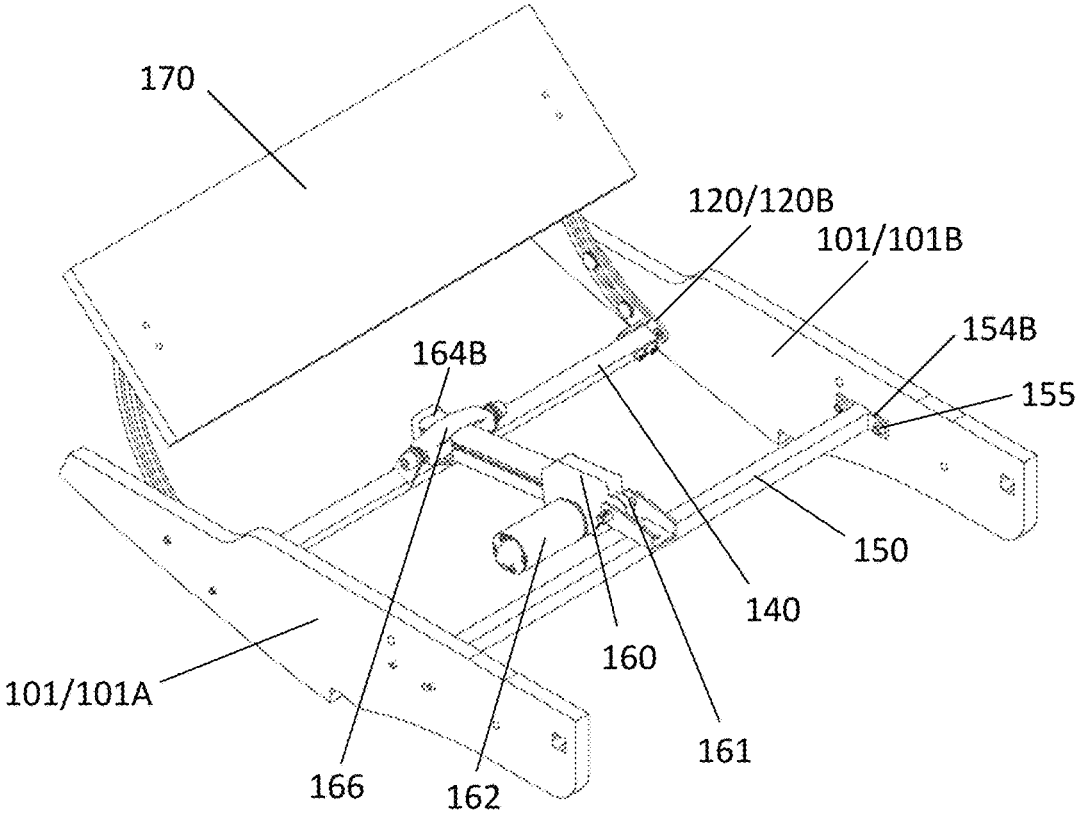
FIG. 6 shows schematically a perspective view of an adjustable headrest mechanism according to one embodiment of the invention.
Figure 7:
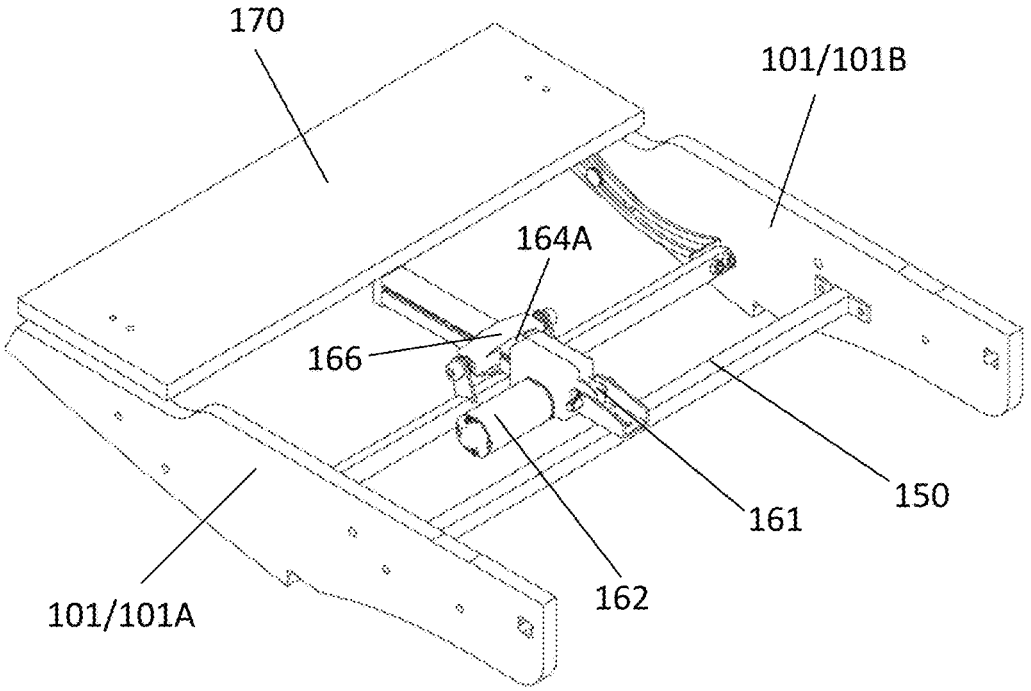
FIG. 7 shows schematically another perspective view of the adjustable headrest mechanism shown in FIG. 6.

The adjustable headrest mechanism 100 also has a pair of side plates 120 including a left side plate 120A and a right side plate 120B. Similarly, reference numeral 120 refers to the pair of side plates, while reference numerals 120A and 120B refer respectively to a left plate and a right plate of the pair of side plates. The left side plate 120A is operably coupled between the left sliding rail 110A and the left side board 101A of the back frame 101 of the chair, while the right side plate 120B is operably coupled between the right sliding rail 110B and the right side board 101B of the back frame 101, as shown in FIGS. 6-7.

Each side plate 120A/120B has a first side operably attached to the respective side board 101A/101B of the back frame 101 of the chair, an opposite, second side, and at least one guiding post 130 fixed on the second side. The at least one guiding post 130 is received in the guiding groove 114 of the respective sliding rail 110A/110B of the pair of sliding rails 110 such that the respective sliding rail 110A/110B is movable along the at least one guiding post 130. The at least one guiding post 130 can be riveted on, welded to, screwed in, or protruded from the second side of each side plate 120A/120B. In the exemplary embodiment shown in FIGS. 3-7, each side plate 120A/120B has two guiding post 130. It should be noted that other numbers of the guiding posts can also be utilized to practice the invention.

In addition, each guiding post 130 is equipped with a bushing 112 and a gasket 114. The bushing 112 is adapted for isolating the sliding rail 110 and the guiding post 130 to prevent the metals from rubbing against each other to generate noise and ensure smooth operation. The gasket 114 is placed between the sliding rail 110 and the side plate 120 to prevent noises from rubbing between metals. In certain embodiments, the bushing 112 and the gasket 114 are formed of plastic. It should be noted that the bushing 112 and the gasket 114 may be formed of other elastic materials.

The adjustable headrest mechanism 100 further includes a lower driving rod 150 having two end portions 153A and 153B attached to the left and right side boards 101A and 101B, respectively, of the back frame 101 of the chair. The adjustable headrest mechanism 100 also includes an upper driving rod 140 arranged parallel to the lower driving rod 150. Two end portions 143A and 143B of the upper driving rod 140 are attached to the lower end portions 112A and 112B of the left and right sliding rails 110A and 110B, respectively, for example, by screws and nuts 144, or other connection means, through holes formed on the two end portions 143A and 143B of the upper driving rod 140. The holes are waist-shaped slot holes adapted for adjusting a width between the pair of sliding rails 110.

In addition, the adjustable headrest mechanism 100 also includes a headrest actuator 160 pivotally connected between the upper driving rod 140 and the lower driving rod 150 for operably driving the upper driving rod 140 to move between a first position and a second position, thereby driving the pair of sliding rails 110 to pivotally move in an upward direction or a downward direction relative to the lower driving rod 150. Specifically, when the upper driving rod 140 moves from the first position to the second position, the movement of the upper driving rod 140 drives the pair of sliding rails 110 to move along with the guiding posts 130 in the upward direction. On the other hand, when the upper driving rod 140 moves from the second position to the first position, the movement of the upper driving rod 140 drives the pair of sliding rails 110 to move along with the guiding posts 130 in the downward direction.

Figure 3:
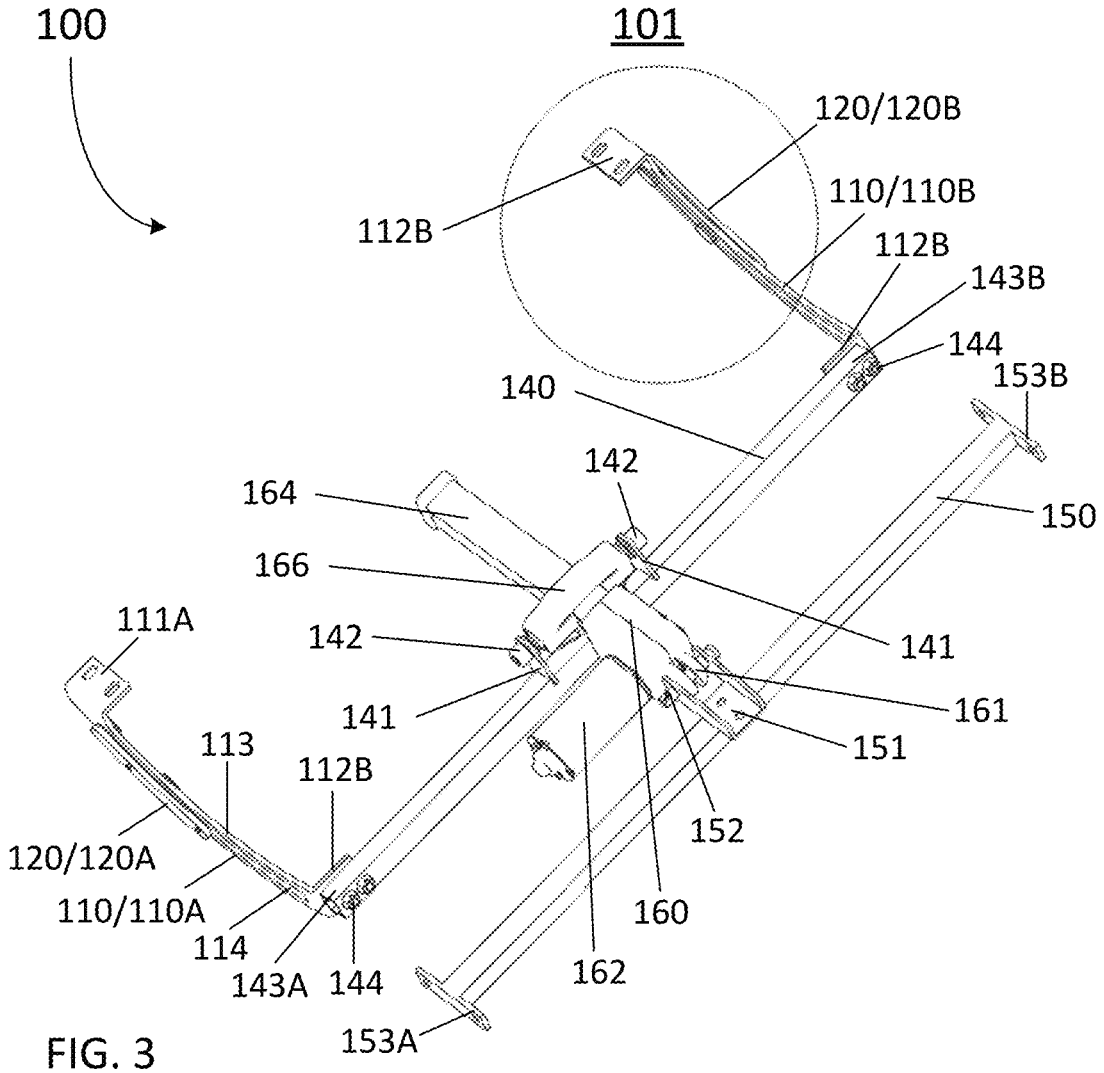
FIG. 3 shows schematically a perspective view of an adjustable headrest mechanism according to one embodiment of the invention.
Figure 4:
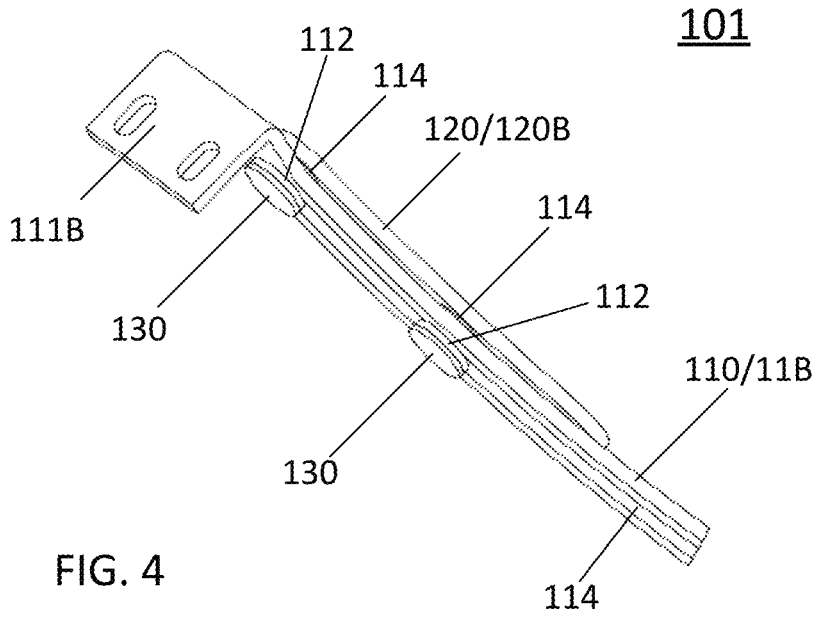
FIG. 4 shows schematically a partially enlarged view of the adjustable headrest mechanism shown in FIG. 3.
Figure 5:
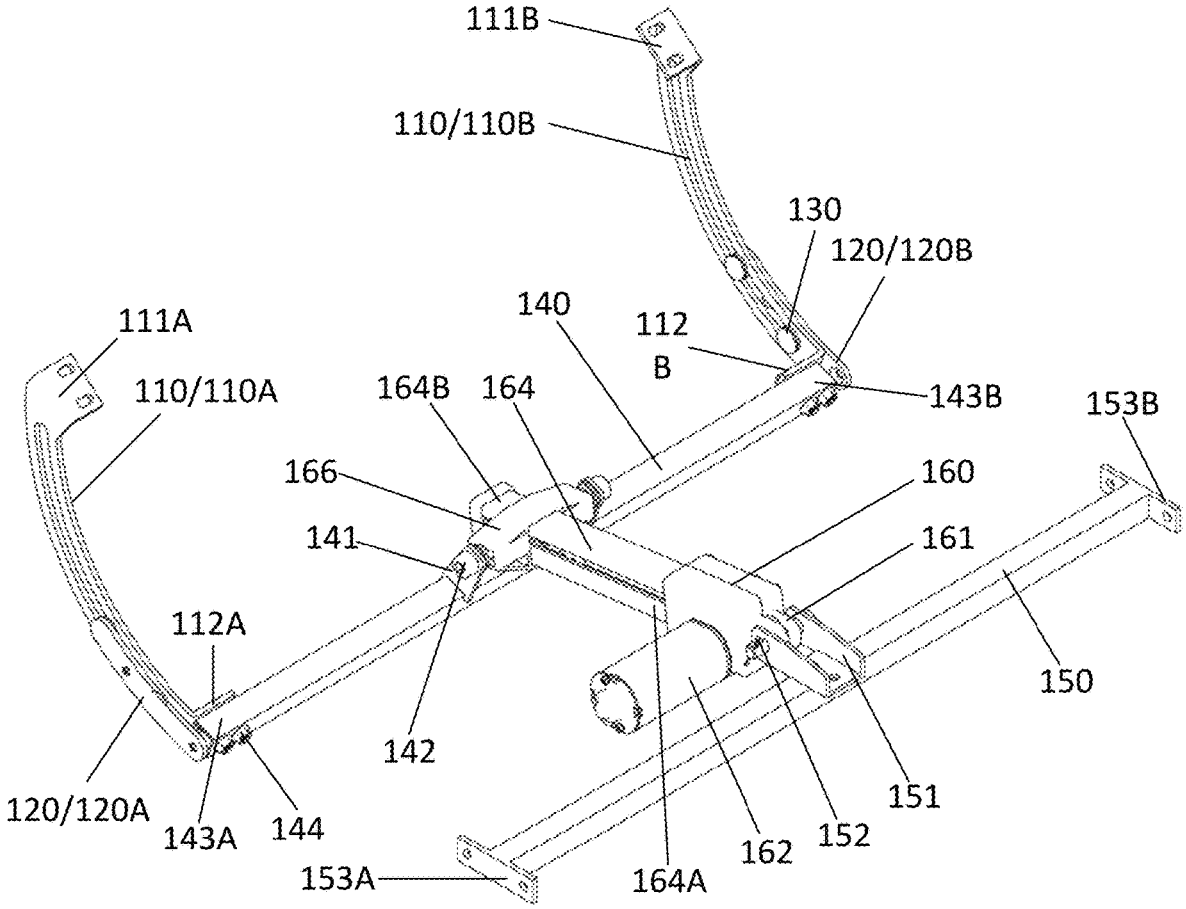
FIG. 5 shows schematically another perspective view of the adjustable headrest mechanism shown in FIG. 3.

In the exemplary embodiment shown in FIGS. 3-7, the headrest actuator 160 comprises a slider 166 pivotally connected to the upper driving rod 140, a guiding bar 164 having a proximal end portion 164A and an opposite, distal end portion 164B, received in the slider 166, and a motor member 162 connected to the proximal end portion of the guiding bar 164 to drive the slider 166 to move along the guiding bar 164 between the proximal end portion 164A and the distal end portion 164B, thereby driving the upper driving rod 140 to move between the first position and the second position. When the slider 166 moves to the proximal end portion 164A, the upper driving rod 140 is in the first position in which the side boards 120 is proximate to the upper end portion 111A/111B of the pair of sliding rails 110, as shown in FIG. 3, and when the slider 166 moves to the distal end portion 164B, the upper driving rod 140 is in the second position in which the side boards 120 is proximate to the lower end portion 112A/112B of the pair of sliding rails 110, as shown in FIG. 5.

The slider 166 is pivotally connected to the upper driving rod 140 through an upper bracket 141 mounted on the upper driving rod 140 and a shaft screw 142 connected to the slider 166 and the upper bracket 141, such that the upper driving rod 140 is rotatable around the shaft screw 142.

The headrest actuator 160 is also pivotally connected to the lower driving rod 150 at a lower end 161 of the headrest actuator 160 that is proximate to the motor member 162 through a lower bracket 151 mounted on the lower driving rod 150 and a pin 152 pivotally connected to the lower end 161 of the headrest actuator 160 and the lower bracket 151.

In operation, the motor member 162 drives the slider 166 to reciprocate up and down along the guiding bar 164 between the proximal end portion 164A and the distal end portion 164B, the reciprocation of the slider 166 in turn drives the upper driving rod 140 and thus the sliding rail 110 to reciprocate up and down along the guiding post 130, thereby realizing the up and down movement of the headrest broad 170.

When the slider 166 moves to the proximal end portion 164A of the guiding bar 164, the upper driving rod 140 is in the first position, the headrest broad 170 is in the complete close state, as shown in FIG. 7. When the slider 166 moves to the distal end portion 164B of the guiding bar 164, the upper driving rod 140 is in the second position, the headrest broad 170 is in the complete open state, as shown in FIG. 6. Depending upon the user's preference, the headrest broad 170 can be adjusted to the complete close state, the complete open state, or any other positions between the complete close state an d the complete open state.

Figure 2:
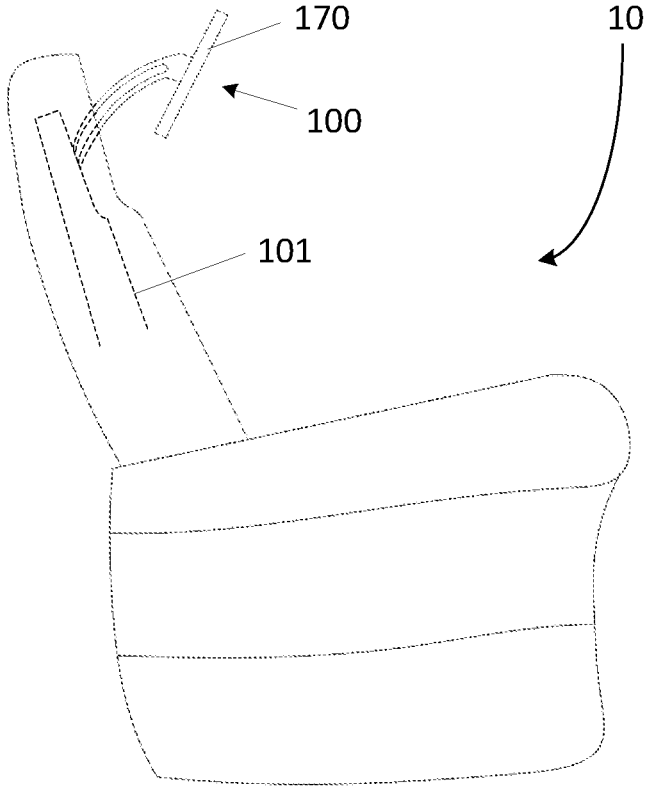
FIG. 2 shows schematically a side view of a chair with an adjustable headrest mechanism according to one embodiment of the invention.

In another aspect of the invention, as shown in FIGS. 1-2, the chair 10 comprises a back frame 101; and an adjustable headrest mechanism 100 attached to the back frame 101 for operably adjusting a headrest 170 at desired positions. The details of the adjustable headrest mechanism 100 are disclosed above and not repeated herewith.

According to the invention, an adjustable headrest mechanism 100 that utilizes an arc-shaped sliding rail structure to open (i.e., move in a upward direction) and close (i.e., move in a downward direction) can minimize the tilt angle of the headrest when opening, and ensure that the headrest is always in the surface contact with the user's head, thereby reducing the pressure of the headrest exerted on the head, and at the same time it can ensure that the user can look straight ahead more comfortably.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable headrest mechanism for a chair, comprising:

a pair of sliding rails transversely spaced, longitudinally aligned and arranged parallel to each other, each of the pair of sliding rails having an upper end portion and a lower end portion, and a sliding rail body portion formed therebetween, wherein each of the pair of sliding rails has a guiding groove formed in the sliding rail body portion;

an upper driving rod and a lower driving rod longitudinally spaced, transversely aligned and arranged parallel to each other, wherein two end portions of the upper driving rod are attached to two lower end portions of the pair of sliding rails, and two end portions of the lower driving rod are operably attached to a back frame of the chair;

a headrest actuator pivotally connected between the upper driving rod and the lower driving rod for operably driving the upper driving rod to move between a first position and a second position, thereby driving the pair of sliding rails to pivotally move in an upward direction or a downward direction relative to the lower driving rod, wherein when the upper driving rod is in the first position, the pair of sliding rails is in a complete close state, and when the upper driving rod is in the second position, the pair of sliding rails is in a complete open state; and a pair of side plates, each side plate operably coupled between a respective sliding rail of the pair of sliding rails and the back frame of the chair, wherein each side plate has a first side operably attached to the back frame of the chair, an opposite, second side, and at least one guiding post fixed on the second side, wherein the at least one guiding post is received in the guiding groove of the said respective sliding rail of the pair of sliding rails such that said respective sliding rail is movable along the at least one guiding post, and wherein the two lower end portions of the pair of sliding rails are fixedly connected with the two end portions of the upper driving rod by screws and nuts, or other connection means, through holes formed on the two end portions of the upper driving rod, wherein the holes are waist-shaped slot holes adapted for adjusting a width between the pair of sliding rails.

2. The adjustable headrest mechanism of claim 1, wherein each of the pair of sliding rails has a guiding groove formed in the sliding rail body portion.

3. The adjustable headrest mechanism of claim 2, wherein the guiding groove is an arc-shaped groove.

4. The adjustable headrest mechanism of claim 2, further comprising a pair of side plates, each side plate operably coupled between a respective sliding rail of the pair of sliding rails and the back frame of the chair.

5. The adjustable headrest mechanism of claim 4, wherein each side plate has a first side operably attached to the back frame of the chair, an opposite, second side, and at least one guiding post fixed on the second side, wherein the at least one guiding post is received in the guiding groove of the said respective sliding rail of the pair of sliding rails such that said respective sliding rail is movable along the at least one guiding post.

6. The adjustable headrest mechanism of claim 5, wherein the at least one guiding post is riveted on, welded to, screwed in, or protruded from the second side of each side plate.

7. The adjustable headrest mechanism of claim 5, wherein each guiding post is equipped with a bushing and a gasket, wherein the bushing is adapted for isolating the sliding rail and the guiding post, and wherein the gasket is placed between the sliding rail and the side plate.

8. The adjustable headrest mechanism of claim 7, wherein the bushing and the gasket are formed of plastic.

9. The adjustable headrest mechanism of claim 5, wherein the two lower end portions of the pair of sliding rails are fixedly connected with the two end portions of the upper driving rod by screws and nuts, or other connection means, through holes formed on the two end portions of the upper driving rod, wherein the holes are waist-shaped slot holes adapted for adjusting a width between the pair of sliding rails.

10. The adjustable headrest mechanism of claim 1, wherein the headrest actuator comprises a slider pivotally connected to the upper driving rod, a guiding bar received in the slider, and a motor member engaged with the guiding bar and the slider to drive the slider to move along the guiding bar, thereby driving the upper driving rod to move between the first position and the second position.

11. A chair, comprising:

a back frame; and an adjustable headrest mechanism attached to the back frame for operably adjusting a headrest at desired positions, wherein the adjustable headrest mechanism is according to claim 1.

12. An adjustable headrest mechanism for a chair, comprising:

a pair of sliding rails transversely spaced, longitudinally aligned and arranged parallel to each other, each of the pair of sliding rails having an upper end portion and a lower end portion, and a sliding rail body portion formed therebetween;

an upper driving rod and a lower driving rod longitudinally spaced, transversely aligned and arranged parallel to each other, wherein two end portions of the upper driving rod are attached to two lower end portions of the pair of sliding rails, and two end portions of the lower driving rod are operably attached to a back frame of the chair; and a headrest actuator pivotally connected between the upper driving rod and the lower driving rod for operably driving the upper driving rod to move between a first position and a second position, thereby driving the pair of sliding rails to pivotally move in an upward direction or a downward direction relative to the lower driving rod, wherein when the upper driving rod is in the first position, the pair of sliding rails is in a complete close state, and when the upper driving rod is in the second position, the pair of sliding rails is in a complete open state, wherein the headrest actuator comprises a slider pivotally connected to the upper driving rod, a guiding bar received in the slider, and a motor member engaged with the guiding bar and the slider to drive the slider to move along the guiding bar, thereby driving the upper driving rod to move between the first position and the second position; and wherein the slider is pivotally connected to the upper driving rod through an upper bracket mounted on the upper driving rod and a shaft screw connected to the slider and the upper bracket, such that the upper driving rod is rotatable around the shaft screw.

13. The adjustable headrest mechanism of claim 12, wherein the headrest actuator is also pivotally connected to the lower driving rod at a lower end portion of the headrest actuator that is proximate to the motor member through a lower bracket mounted on the lower driving rod and a pin pivotally connected to the lower end portion of the headrest actuator and the lower bracket.

14. The adjustable headrest mechanism of claim 12, further comprising a headrest broad attached to the upper end portions of the pair of sliding rails.

15. The adjustable headrest mechanism of claim 14, wherein in operation, the motor member drives the slider to reciprocate up and down along the guiding bar, the reciprocation of the slider in turn drives the upper driving rod and thus the sliding rail to reciprocate up and down along the guiding post, thereby realizing the up and down movement of the headrest broad to operably adjust the headrest broad at desired positions.

16. The adjustable headrest mechanism of claim 15, wherein when the slider moves to the proximal end portion of the guiding bar, the upper driving rod is in the first position, the headrest broad is in the complete close state, and wherein when the slider moves to the distal end portion of the guiding bar, the upper driving rod is in the second position, the headrest broad is in the complete open state.

17. A chair, comprising:

a back frame; and an adjustable headrest mechanism attached to the back frame for operably adjusting a headrest at desired positions, wherein the adjustable headrest mechanism is according to claim 12.

* * * * *